United States Patent [19]

Barendsen et al.

[11] Patent Number: 4,834,580

[45] Date of Patent: May 30, 1989

[54] METHOD AND DEVICE FOR DRIVING A TUNNEL

[75] Inventors: Pieter Barendsen, Tyresö ; Bo O. R. Arnegård, Skärholmen, both of Sweden

[73] Assignee: Atlas Copco Aktiebolag, Stockholm, Sweden

[21] Appl. No.: 113,618

[22] Filed: Oct. 26, 1987

[30] Foreign Application Priority Data

Nov. 19, 1986 [SE] Sweden ..... 8604940

[51] Int. Cl.[4] ..... E21D 9/00

[52] U.S. Cl. ..... 405/138; 405/141; 405/146

[58] Field of Search ..... 405/132, 138, 139, 140, 405/141, 145, 146, 150; 299/33

[56] References Cited

U.S. PATENT DOCUMENTS

| | | | |
|---|---|---|---|
| 3,597,929 | 8/1971 | Bodine | 405/140 |
| 3,640,077 | 2/1972 | Watson et al. | 405/140 |
| 4,459,064 | 7/1984 | Berset | 405/138 |
| 4,666,336 | 5/1987 | Murakami et al. | 405/138 |

*Primary Examiner*—David H. Corbin

*Attorney, Agent, or Firm*—Eric Y. Munson

[57] ABSTRACT

Method and device for driving a tunnel by means of a tunneling machine (10). At the same time as the tunnel is driven, an injection hole (91) is drilled in front of the tunnel front (90) by a rock drilling machine (53) placed behind the tunneling machine.

10 Claims, 2 Drawing Sheets

METHOD AND DEVICE FOR DRIVING A TUNNEL

BACKGROUND OF THE INVENTION

The present invention relates to a method and a device for driving a tunnel by means of a tunneling machine, i.e. the tunnel is driven without the use of explosives.

In order to secure the driving of the tunnel in rock zones which are weak or water bearing, injection holes must be drilled in front of the tunneling machine. This has earlier been done by means of drilling equipment positioned in front of or on the tunneling machine. It has thereby been necessary to discontinue the tunnel driving. As a result, a lower tunnel driving velocity has been obtained.

SUMMARY OF THE INVENTION

The present invention, which is defined in the appended claims, aims at making it possible to drive the tunnel at the same time as injection holes are drilled in front of the tunnel front. The invention makes it possible to create a shield of rock where the small cracks have been filled with concrete about the tunnel profile ahead of the already driven tunnel.

BRIEF DESCRIPTION OF THE DRAWINGS

An embodiment of the invention is described below with reference to the accompanying drawing in which.

DESCRIPTION OF THE BEST MODE FOR CARRYING OUT THE INVENTION

Figure 1:
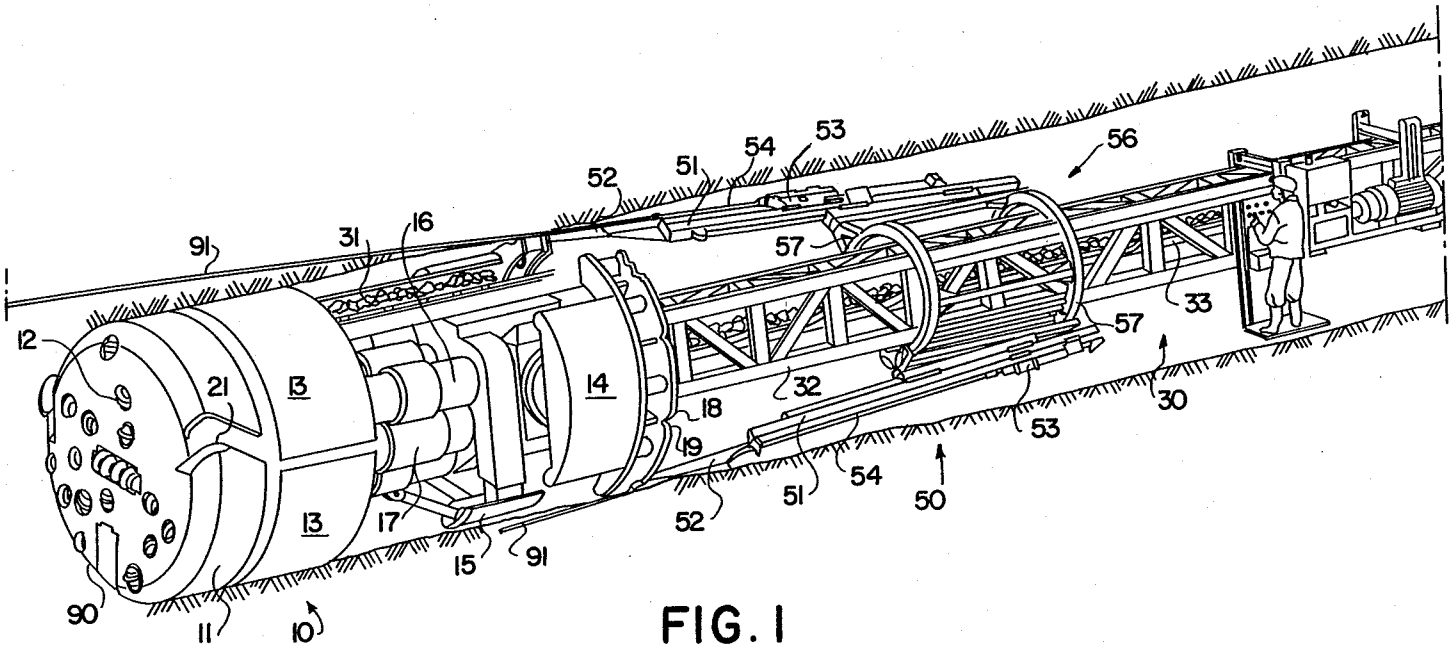
FIG. 1 shows a tunneling machine according to the invention.

The device shown in FIG. 1 comprises a tunneling machine 10, a transport device 30 for the transport away of fragmented rock from the tunnel front 90 and a device 50 for drilling injection holes 91. The tunneling machine 10 comprises a rotatable drill head 11 provided with rollers 12 which during the driving of the tunnel are driven into the front surface 90 for fragmentation of the rock. The machine 10 further comprises a pair of front clamping shoes 13 and a pair of rear clamping shoes 14 by means of which the machine is clamped in the tunnel when this is driven. The front clamping shoes are furthermore used for controlling the machine in the vertical plane. The rear clamping shoes are used for controlling the machine in the horizontal plane. The machine is furthermore provided with hydraulically actuatable supports 15 on which the machine is carried when the clamping shoes 14 are moved to take a new grip against the tunnel wall. The drill head 11 is pressed against the front surface by means of hydraulic cylinders 16. The reaction force is taken up by the tunnel wall via the clamping shoes 14. The machine furthermore comprises a number of front, not shown, hydraulic cylinders which press the drill head against the tunnel front and rest against the front clamping shows 13. Through this a continuous driving of the tunnel is made possible since the clamping shoes 14 at the same time can be moved towards the tunnel front to a new gripping position. The drill head 11 is driven by electric motors and gears 17. The clamping shoes 14 are provided with segments 18 provided with v-formed support cut-outs 19 for supporting the drill guides 52 on the drilling device 50.

For the transport away of fragmented rock from the tunnel front 90, the drill head 11 is provided with a number of plates 21 and scoops, not shown, which transport the rock fragments to an upper position where the fragments are allowed to fall down on a conveyor 31 which forms part of the transport device 30. The device 30 further comprises a frame work 32 in which a conveyor 33 is operating.

The device 50 for drilling injection holes comprises a carriage 56 which is movable along the frame work 32. The carrier 56 is provided with two rails 57 on which two feed beams 51 are movably mounted with a small angle, e.g. 3°, relative to the longitudinal axis of the tunnel. The feed beams can be moved about the longitudinal axis of the tunnel on these rails. A rock drilling machine 53 is reciprocably movable along the feed beam 51 in order to drill a drill hole 91 by means of a drill tool 54 at the same time as the drill head 11 is driven into the front surface 90. The feed beam 51 is at its front end provided with a drill guide 52 which cooperates with one of the v-formed cut-outs 19 on the segment 18. During collaring of the hole 91, segment 18 takes a fixed position relative to the tunnel wall. If the drilling time for the hole 91 exceeds the time between two movements of clamping shoes 14 carriage 56 must be movable relative to the frame work 32 in order to be fixed relative to the tunnel wall during the entire time for the drilling of hole 91. When drilling holes 91 in front of the tunnel front 90 the drill tool must be extended. This is done manually.

Figure 2:
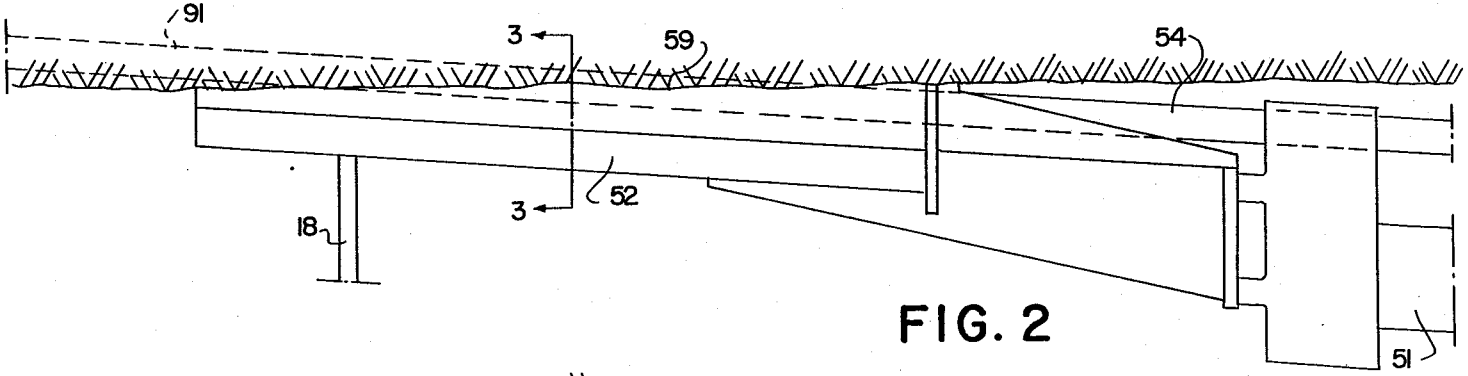
FIG. 2 shows on a larger scale a detail of the device according to FIG. 1.
Figure 3:
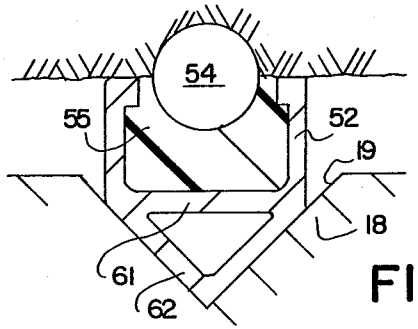
FIG. 3 shows a section according to 3—3 in FIG. 2.

In FIGS. 2 and 3 it is shown more in detail how the drill guide is formed. It comprises a steel part 52 which during drilling of the hole 91 is clamped between the v-formed support cut-out 19 on segment 18 and the tunnel wall. A plastic insert 55 is placed in the steel part 52. The drill guide 52 is formed such that a small angle, e.g. 3°, is obtained between the direction of the hole 91 and the surface 59 which rests against the tunnel wall during drilling. The steel part 52 comprises a channel 61 with a substantially rectangular cross section in which the plastic insert 55 is placed. The part 52 furthermore comprises a v-formed support part 62 for cooperation with the support cut-out 19.

We claim:

1. A method of driving a tunnel with a tunneling machine including a drill head (11), the steps of said method comprising:

driving said drill head into the front surface (90) of a tunnel, and simultaneously drilling at least one drill hole (91) adapted to receive reinforcing material into the front surface of the tunnel at an angle relative to the longitudinal axis of the tunnel at the same time that said drill head is driven into the front surface of said tunnel.

2. The method of claim 1 further including the step of drilling said at least one drill hole from a position behind said tunneling machine.

3. The method of claim 1 further including the step of drilling said at least one drill hole at a small angle relative to said longitudinal axis of said tunnel.

4. The method of claim 1 further including the step of drilling said at least one drill hole at an angle of substantially 3° relative to said longitudinal axis of said tunnel.

5. An apparatus for driving a tunnel comprising a tunneling machine (10) having a drill head (11) to be driven into a front surface (90) of a tunnel; said apparatus further including a drilling device (50); said drilling device comprising a feed beam (51) oriented at an angle relative to the longitudinal axis of the tunnel, a drill guide (52) on the feed beam for guiding a drill tool (54), and a drilling machine (53) reciprocally movable along the feed beam for drilling a hole with said drill tool; said drilling device being arranged relative to the tunnel for drilling at least one hole adapted to receive reinforcing material in front of the front surface (90) of the tunnel simultaneously at the same time as said drill head (11) of said tunneling machine (50) is driven into the front surface (90) of the tunnel.

6. The apparatus of claim 5 wherein said feed beam is oriented at a small angle relative to the longitudinal axis of said tunnel.

7. The apparatus of claim 6 wherein said feed beam is oriented at an angle of substantially 3° relative to the longitudinal axis of said tunnel.

8. The apparatus of claim 5 wherein said drilling device (50) is arranged behind said tunneling machine.

9. The apparatus of claim 5 wherein said drill guide comprises a steel part (52) and a plastic insert (55) received in said steel part for guiding the drill tool (54).

10. The apparatus of claim 9 wherein said steel part (52) comprises a channel (61) having a substantially rectangular cross section for receiving said plastic insert (55) and a V-shaped supporting part (62) which cooperates with a V-shaped supporting cut-out (19) defined on said tunneling machine (10).

* * * * *